United States Patent [19]

Broersma

[11] 4,126,769

[45] Nov. 21, 1978

[54] MOVING ARMATURE TRANSDUCER WITH REINFORCED AND PIVOTED DIAPHRAGM

[75] Inventor: Harmen Broersma, Amsterdam, Netherlands

[73] Assignee: Microtel B.V., Amsterdam, Netherlands

[21] Appl. No.: 839,210

[22] Filed: Oct. 4, 1977

[30] Foreign Application Priority Data

Oct. 11, 1976 [NL] Netherlands ..... 7611218

[51] Int. Cl.[2] ..... H04R 11/00

[52] U.S. Cl. ..... 179/115 A; 179/181 R

[58] Field of Search ..... 179/114 A, 115 A, 115 R, 179/181 R

[56] References Cited

U.S. PATENT DOCUMENTS

| | | | |
|---|---|---|---|
| 3,573,397 | 4/1971 | Sawer et al. | 179/115 R |
| 3,617,653 | 11/1971 | Tibbetts et al. | 179/114 A |
| 3,701,865 | 10/1972 | Carlson et al. | 179/181 R |
| 3,935,398 | 1/1976 | Carlson et al. | 179/114 A |

*Primary Examiner*—George G. Stellar

*Attorney, Agent, or Firm*—Brady, O'Boyle & Gates

[57] ABSTRACT

An electro-acoustic transducer in which a diaphragm has a stiffened portion which at the one hand is pivotally connected to a fixed frame portion, and at a location offset from the center of the diaphragm is connected to a U-form armature of an electromagnetic unit at the other, whereby the average amplitude of the movement of said diaphragm caused by a movement of the free end of said armature is greater than the amplitude of the latter movement.

5 Claims, 2 Drawing Figures

MOVING ARMATURE TRANSDUCER WITH REINFORCED AND PIVOTED DIAPHRAGM

Figure 1:
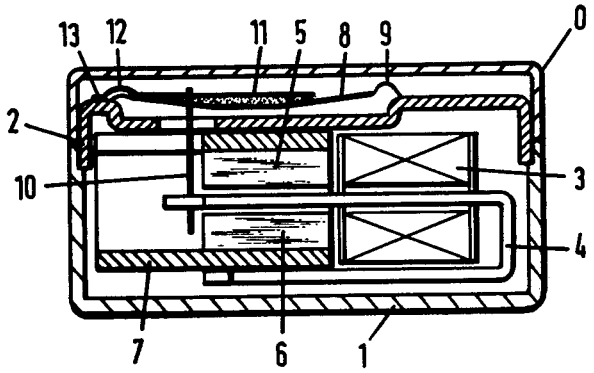

This invention relates to an electro-acoustic transducer.

In U.S. Pat. No. 3,742,156, issued June 26, 1973, and in the corresponding British patent specification No. 1,357,403, sealed Oct. 16, 1974, there is described and shown an electro-acoustic transducer comprising a mounting plate carried in a housing and in turn carrying a drive section including an electric coil and a substantially U-shaped armature supported so that one leg extends through the coil for free movement between two permanent magnets mounted in a magnet support; an acoustic section comprising a diaphragm carried by a rim secured to the mounting plate; and a coupling member serving to transmit a displacement of the free end of the armature to the diaphragm.

In an electro-acoustic transducer constructed and arranged in accordance with these prior proposals, the stiffness of the drive section and the load thereon are approximately matched to each other, which implies that the transmission is good in respect of the lower part of the frequency range. The mass load, however, is extremely high, which results in less good matching with regard to the higher part of the frequency range. In other words the acoustic characteristics of a transducer constructed and arranged in accordance with these prior proposals admit of improvement, in particular with regard to the higher part of the frequency range.

It is an object of the present invention to meet this drawback by the provision of an electro-acoustic transducer havng improved characteristics with regard to the higher part of the frequency range, that is to say, up to approximately 7000 to 10,000 cycles, without thereby impairing the lower part of the frequency band.

According to the present invention, there is provided in an electro-acoustic transducer comprising a mounting plate in a housing and in turn carrying a drive section including an electric coil and a substantially U-shaped armature supported so that one leg extends through the coil for free movement between two permanent magnets mounted in a magnet support; an acoustic section comprising a diaphragm carried by a rim secured to the mounting plate; and a coupling member serving to transmit a displacement of the free end of the armature to the diaphragm, the improvement which comprises that said diaphragm includes a stiffened portion secured to the mounting plate adjacent to a portion of said rim so as to be tiltable relatively to said mounting plate, the arrangement being such that a displacement of the free end of the armature causes a displacement of the diaphragm of an average amplitude greater than that of the armature displacement.

In an electro-acoustic transducer constructed and arranged in accordance with the present invention it is possible to increase the maximum acoustic input and minimize susceptibility to shocks. Magnetic shielding can be effectively realized, while reproducibility in mass manufacture is equivalent to that applying to transducers constructed in accordance with the prior proposals referred to above.

For good operation of a transducer according to the present invention, it is of importance that the diaphragm be locally stiffened with a minimum mass. For this purpose, use may be made of a separate stiffening strip, which is secured to the diaphragm. Such a stiffened portion serves a dual purpose. On the one hand, the diaphragm is stiffened in the longitudinal direction thereof by the stiffening strip secured to it, for example, by means of an adhesive. On the other hand, the stiffened portion forms a means for causing the diaphragm to tilt locally relatively to the place where it is attached to the mounting plate.

Unlike the prior proposals referred to above, an electro-acoustic transducer in accordance with the present invention allows the free selection of the matching factor between the mechanical impedance of the drive or motor section and that of the acoustic section.

In a transducer constructed in accordance with the above prior proposals, in which there is no such possibility of a free selection, the desired dimensions and practicable constructions lead to less than optimal matching to the lower part of the frequency band (motor stiffness approximately equal to stiffness of diaphragm or rear volume), while the matching to the higher part of the frequency band (in other words to frequencies in excess of the resonance frequency) is unfavourable.

In a transducer constructed in accordance with the present invention, the matching to the higher part of the frequency range is virtually optimal, without the transmission applying to the lower part of the frequency band becoming worse than that in a transducer constructed in accordance with the above prior proposals.

Figure 2:
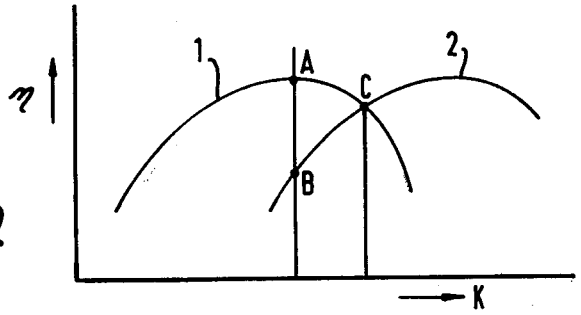

One embodiment of the present invention will now be described, by way of example, with reference to the accompanying drawing. In said drawings, FIG. 1 shows a cross-sectional view of one embodiment of an electro-acoustic transducer according to the present invention;

FIG. 2 is a graph showing the relation between the matching factor and the high-frequency and low-frequency efficiency of the transducer; and FIG. 3 is a perspective view of the acoustic section of the transducer of the present invention.

Referring to FIG. 1, there is shown an electro-acoustic transducer according to the present invention, having a conventional cover O, and a housing 1 carrying a mounting plate 2. The mounting plate carries in turn at its bottom side a drive or motor section including an electric coil 3 secured to the mounting plate or to the magnet set, and a substantially U-shaped armature 4 supported, by means not shown, so that one leg thereof extends through the coil for free movement between two permanent magnets 5 and 6, carried in a magnet support 7. The transducer further comprises an acoustic section including a diaphragm 8 carried by a surround 9 secured to the mounting plate, and a coupling member 10 serving to transmit a displacement of the free end of armature 4 to the diaphragm. For completeness' sake it is noted that the acoustic section is further constituted by the volume of air present behind the diaphragm, the volume of air present in front of the diaphragm, and also the conventional tube through which sonic energy can be transmitted to an ear or artificial ear.

According to the present invention, diaphragm 8 is provided with a stiffened portion which, in the embodiment shown, is formed by a stiffening plate 11, secured to the top of the diaphragm, for example by means of a suitable adhesive. The end of plate 11 adjacent to surround 9 is coupled to mounting plate 2 in such a manner that plate 11 and hence the diaphragm portion to which it is connected are tiltable relatively to the mounting plate. Such a pivoting construction can be realized in various ways. In the embodiment shown, such a connection is formed by a portion 12 of plate 11 being curved over the adjacent portion of surround 9, with the contiguous end portions 13 of plate 11 being secured to mounting plate 2, for example, with a suitable adhesive. The curved portion 12 may be formed by one or more strips integral with plate 11. In a preferred embodiment, portions 12 and 13 have a cut-out, so that plate 11 is in fact secured to the mounting plate with two strips.

Furthermore, unlike the above prior proposals, in which the point of engagement of the coupling member is the centre of gravity of the diaphragm or the vibrating plate, according to the present invention the arrangement is such that the coupling member drives the diaphragm at a point intermediate the point of gravity of the diaphragm and the place where plate 11 is secured to the mounting plate. In this arrangement the two permanent magnets and the electric coil are arranged on the same side of this coupling member.

In a preferred embodiment, the ratio between the displacement of the free end of the armature and the portion thereof located in the air gap between the two magnets will be approximately 1.4, and the ratio between the displacement of the point where the coupling member drives the diaphragm and the displacement of the centre of gravity of the diaphragm will be approximately 2.

A comparison of the acoustic characteristics of a transducer constructed in accordance with the prior proposals referred to before and one constructed in accordance with the present invention shows that (a) in spite of the circumstance that in the latter transducer the load is higher than in the former, the low-frequency efficiency, and hence the low-frequency sensitivity of a transducer according to the present invention can be made substantially equal to those of a transducer according to the prior proposals; and (b) the high-frequency efficiency of a transducer according to this invention can be considerably higher than that of a transducer according to the prior proposals.

As stated, unlike the prior proposals referred to, the matching factor between the mechanical impedance of the drive section and that of the acoustic system is a design parameter that can be selected in the arrangement of the present invention. The invention accordingly provides the possibility of realizing a transducer having optimum characteristics.

The above is illustrated in the accompanying FIG. 2, in which the matching factor K is plotted along the axis of abscissas and the efficiency $\eta$ of the transducer along the axis of ordinates. The curves 1 and 2 respectively show the low-frequency efficiency and the high-frequency efficiency as functions of the matching factor. In a transducer constructed according to the prior proposals referred to, the matching factor cannot be freely selected, and the desired dimensions and practicable construction lead to a certain value therefor. It will then be seen that the low-frequency efficiency, indicated by point A, is virtually optimal, but the high-frequency efficiency, indicated by point B, is far from optimal. In a transducer of the present invention, on the other hand, the matching factor is a selectable quantity, given desired dimensions and a practicable construction, and thereby offers the possibility of optimizing both the low-frequency and the high-frequency efficiency. This is indicated in FIG. 2 by point C, where the matching factor has been selected so that the low-frequency efficiency and the high-frequency efficiency are equal to each other. It has been found that the magnitude of the matching factor depends, among other things, on the dimensions and the pivot construction of the stiffened portion, the size of the diaphragm surface area, and the selection of the place where the coupling member is connected to the diaphragm.

A further important aspect of a transducer according to the present invention is that the total mechanical impedance is mainly an acoustic impedance, which is of great significance for the high-frequency reproduction: the overall behaviour of a transducer constructed in accordance with the prior proposals referred to, is determined to a much larger extent by the mechanical impedance of the movable armature leg. As the overall mechanical impedance is a transducer according to the present invention is largely an acoustic impedance, there is ample flexibility in the design of the device as regards form and dimensions of the coupling tubes, while in addition the electrical impedance is much less strongly frequency-dependent than is the case in a transducer constructed in accordance with the prior proposals referred to.

A transducer according to the present invention can be accommodated in a housing whose dimensions are equal to that in which a transducer according to the prior proposals referred to is accommodated.

For completeness' sake it is noted that the stiffened portion of the diaphragm is not necessarily formed by a separate plate secured to it, such as 11. It is also possible to obtain the stiffened portion from the design of the diaphragm proper. Thus the stiffened portion may be obtained by recessing the diaphragm at one or more places. This diaphragm is capable of performing a tilting movement relative to the mounting plate to which this diaphragm portion is pivoted, so that the displacement of the diaphragm adjacent to the point of gravity thereof is correspondingly increased.

I claim:

1. In an electro-acoustic wide band transducer comprising a mounting plate carried in a housing and in turn carrying a drive section including an electric coil and a substantially U-shaped armature supported in such a manner that one leg thereof extends through the coil for free movement between two permanent magnets mounted in a magnet support; an acoustic section comprising a diaphragm carried by a surround secured to the mounting plate; and a coupling member serving to transmit a displacement of the free end of said one leg of the armature to the diaphragm; said diaphragm comprising a stiffened portion secured to the mounting plate adjacent to a portion of said surround so as to be pivotally mounted relatively to said mounting plate; said coupling member being coupled to the diaphragm at a location intermediate the center of gravity of said diaphragm and the location where said stiffened portion borders said surround; said two permanent magnets and said electric coil being arranged on one and the same side of said coupling member; the dimensions and the pivot construction of said stiffened portion, the size of the diaphragm surface area and the location where said coupling member is connected to the diaphragm respectively being such that the low-frequency and the high-frequency efficiencies of said transducer are matched to each other for optimizing the frequency characteristic over the wide-band range.

2. An electro-acoustic transducer according to claim 1, wherein the ratio between the displacement of the free end of said leg of said armature and the portion thereof located in the area between said two magnets is approximately 1.4, and the ratio between the displacement of the location where the coupling member is connected to the diaphragm and the displacement of the center of gravity of said diaphragm is approximately 2.

3. An electro-acoustic transducer according to claim 1, wherein said stiffened portion is secured to the mounting plate by means of one or more strips integral with said stiffened portion and curved over a respective portion of said surround.

4. An electro-acoustic transducer according to claim 3, wherein said stiffened portion comprises a stiffening plate secured to said diaphragm.

5. An electro-acoustic transducer according to claim 4, wherein said stiffening plate is secured to the mounting plate by means of two of said strips, defined by a cut-out in said stiffening plate.

* * * * *